United States Patent [19]

Shinozawa et al.

[11] Patent Number: 4,854,201

[45] Date of Patent: Aug. 8, 1989

[54] VALVE HOLE PUNCHING APPARATUS FOR A WHEEL

[75] Inventors: Yusaku Shinozawa, Tokyo; Shin Sugiura, Toyokawa, both of Japan

[73] Assignee: Topy Kogyo Kabushiki Kaisha, Tokyo, Japan

[21] Appl. No.: 117,553

[22] Filed: Nov. 6, 1987

[51] Int. Cl.[4] ..... B21D 28/30

[52] U.S. Cl. ..... 83/140; 83/188; 83/527; 83/623; 83/639; 83/685; 83/925 R

[58] Field of Search ..... 83/140, 188, 527, 529, 83/639, 684, 685, 700, 925 R, 191, 559, 560, 623

[56] References Cited

U.S. PATENT DOCUMENTS 2,774,426 12/1956 Sharpe ..... 83/639 X
3,722,337 3/1973 Brolund et al. ..... 83/137
4,164,158 8/1979 Peddinghaus ..... 83/191

FOREIGN PATENT DOCUMENTS 2385464 12/1978 France ..... 83/188

*Primary Examiner*—Frank T. Yost
*Assistant Examiner*—Eugenia A. Jones
*Attorney, Agent, or Firm*—Birch, Stewart Kolasch & Birch

[57] ABSTRACT

A valve hole punching apparatus for a vehicle wheel wherein the punch and the bill punching a valve hole in the wheel wall can be adjusted in inclination. In such an apparatus, a wheel into which a valve hole is to be punched is brought to the punching position with its axis maintained in a vertical position. The wheel portion to be punched is punched out by the inclined punch and the bill positioned at a right angle. As a result, handling of the wheel is very easy and punching can be done very smoothly.

10 Claims, 3 Drawing Sheets

VALVE HOLE PUNCHING APPARATUS FOR A WHEEL

BACKGROUND OF THE INVENTION

1. Field of the Invention

The present invention relates to an apparatus for punching out a valve hole in a vehicle wheel.

2. Description of the Related Art

A conventional valve hole punching machine for a vehicle wheel includes a laterally extending U-shaped frame having horizontally extending upper and lower jaws. The punch is mounted on the upper jaw so as to be movable vertically. Wheels into which a valve hole is to be punched are brought to the punching position between the upper and lower jaws and a valve hole is punched out with the punch and the lower jaw by lowering the punch. However, since the portion of a wheel to be punched inclines with respect to the axis of the wheel, the wheel to be punched must be brought to the punching position with its axis maintained in an inclined position from the vertical direction so that the punch hits the wheel portion at a right angle. This setting of the wheel with an inclination has been done heretofore by hand and, accordingly, decreases the punching efficiency.

SUMMARY OF THE INVENTION

An object of the invention is to provide a valve hole punching apparatus wherein wheels into which a valve hole is to be punched are brought to the punching position with the axis of the wheel maintained in a vertical position. Therefore, the wheels can be slid to a punching position on a table having a horizontally extending surface.

The above object can be attained by a valve hole punching apparatus for a wheel in accordance with the present invention, which includes a U-shaped member adapted so as to be adjustable in inclination. The U-shaped member includes upper and lower jaws, the lower jaw including an upwardly extending bill. A punch mounting block is mounted on the U-shaped member so as to be slidable with respect to the U-shaped member between the upper and lower jaws. Driving means are mounted on the upper jaw, for driving the punch mounting block. In addition, a punch is mounted on the punch mounting block, for punching out a valve hole in a wheel wall in cooperation with the bill.

According to the above valve hole punching apparatus, the punch and the bill are adjusted in inclination by adjusting the inclination of the guide so that the axes thereof incline from the vertical direction by the angle defined between the portion of a wheel to be punched and the end of the wheel. Under this condition a wheel to be punched is brought to the punching position with the axis thereof maintained in a vertical position. When the punch is driven to the wheel portion to be punched, the punch and the bill hit the wheel portion at a right angle with respect to the wheel portion and can smoothly punch out a valve hole in the wheel portion. The wheel can be brought to the punching position by sliding the wheel on the horizontally extending plane of a table very easily.

BRIEF DESCRIPTION OF THE DRAWINGS

These and other objects and advantages of the invention will become more apparent and can be more readily appreciated from the following detailed description of the presently preferred exemplary embodiment of the invention taken in conjunction the accompanying drawings, in which.

DETAILED DESCRIPTION OF THE PREFERRED EMBODIMENT

Figure 1:
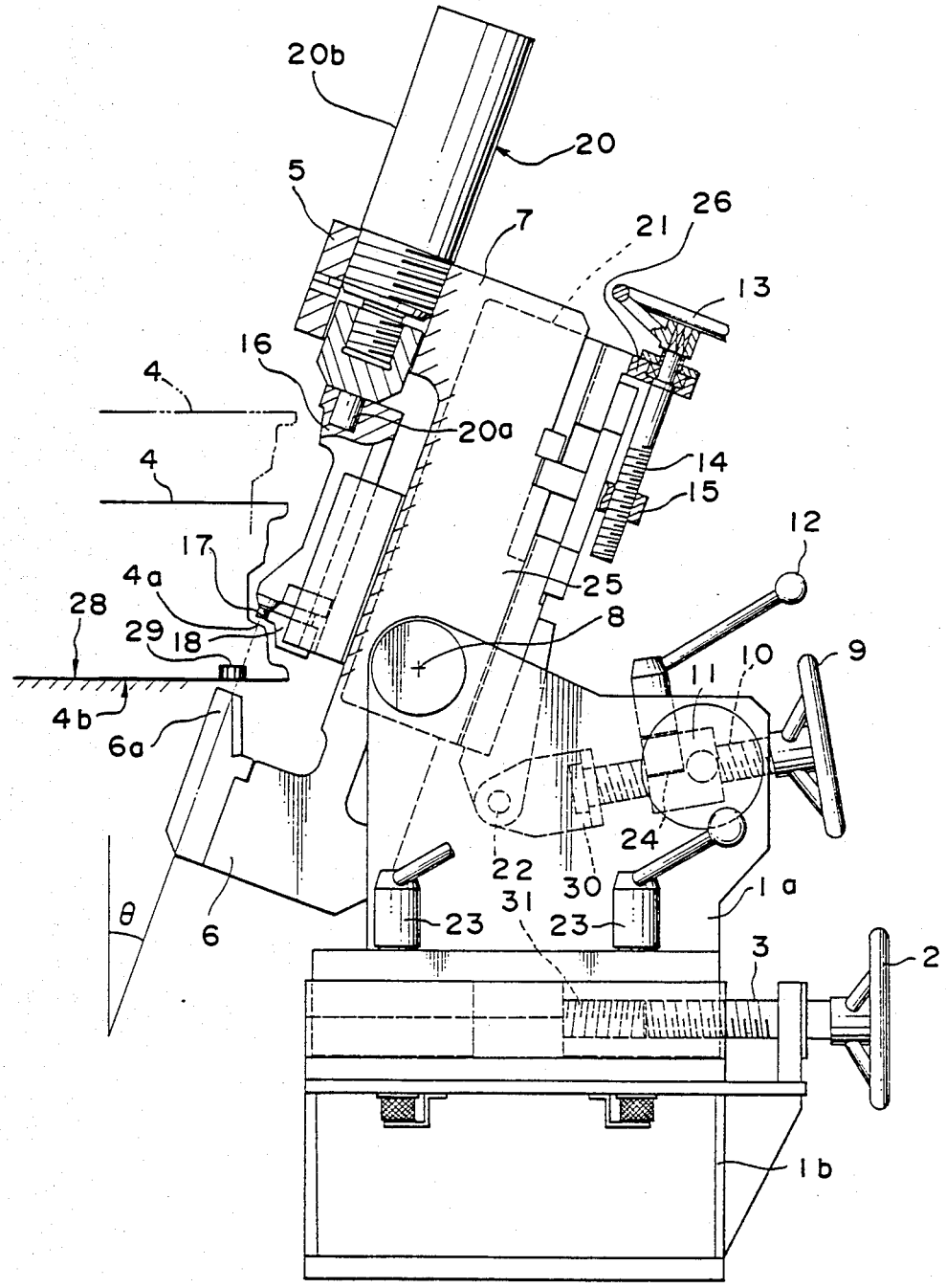
FIG. 1 is a side elevational view, partially shown in cross-section, of a valve hole punching apparatus for a wheel according to one embodiment of the present invention.
Figure 2:
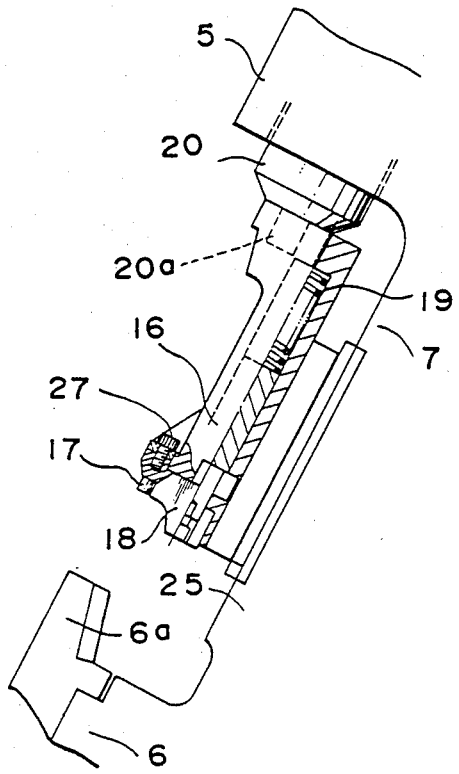
FIG. 2 is an enlarged side elevational view, partially shown in cross-section, of a portion of the apparatus of FIG. 1.
Figure 3:
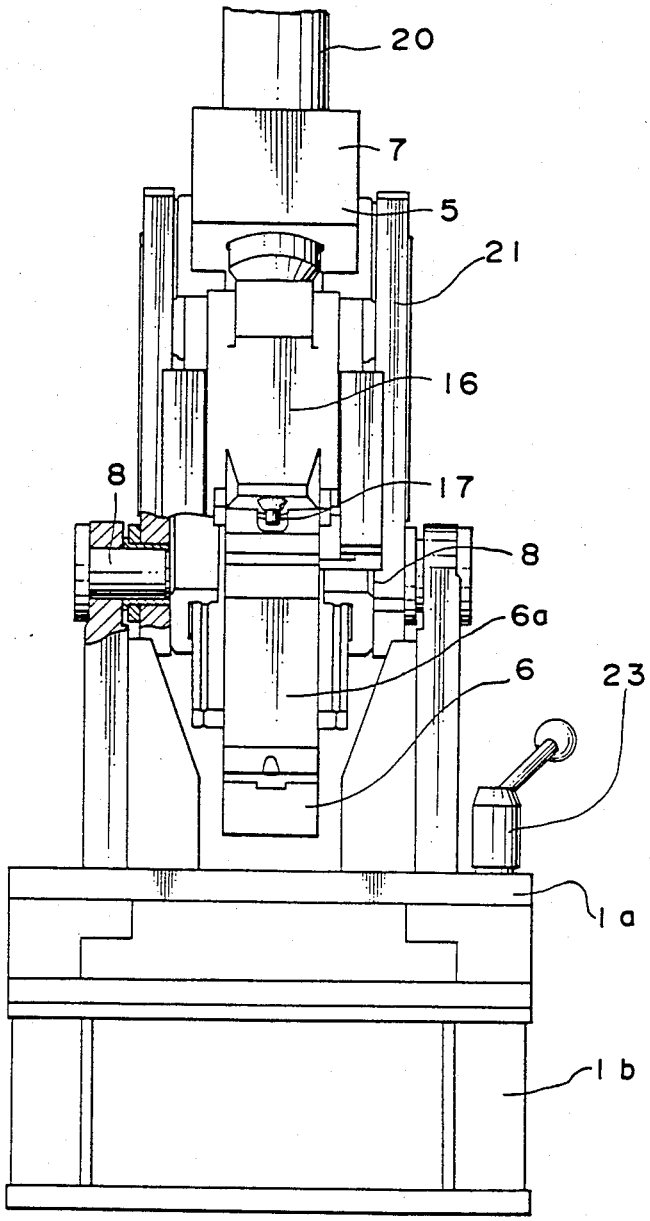
FIG. 3 is a front elevational view of the apparatus of FIG. 1.

A valve hole punching apparatus for a wheel includes a fixed frame 1*b* and a slide table 1*a* adapted to be adjustable in position horizontally with respect to the fixed frame 1*b*. More particularly, a screw 3 of a horizontally extending threaded shaft is mounted between the fixed frame 1*b* and the slide table 1*a*. A handle 2 for rotating the screw 3 is coupled to one end portion of the screw 3. The screw 3 is rotatably but axially fixedly supported by the fixed frame 1*b* and threadingly engages the threads 31 formed in the slide table 1*a* so that rotation of the screw 3 moves the slide table 1*a* horizontally with respect to the fixed frame 1*b*. The slide table 1*a* is adjusted horizontally in position by rotating the screw 3 and is fixed to the fixed frame 1*b* by tightening a bolt and nut mechanism 23.

A guide 21 is mounted on the slide table 1*a* so as to be adjustable in inclination with respect to the slide table 1*a*. More particularly, support shafts 8 are mounted between the slide table 1*a* and the guide 21 and pivotally connect the slide table 1*a* and the guide 21. A bearing 11, which includes threads on the inside surface thereof, is pivotally connected to the slide table 1*a*. A threaded shaft 10 having a handle 9 at its one end is mounted between the bearing 11 and the guide 21. The threaded shaft 10 includes as one portion thereof a connecting block 30 rotatably coupled to the threaded portion of the shaft 10. The threaded shaft 10 threadingly engages the threads of the bearing 11 and is pivotally connected, at the block 30, to the guide 21 via a shaft 22 so that rotation of the threaded shaft 10 axially moves the threaded shaft 10 and, as a result, varies an inclination (angle $\theta$) of the guide 21 with respect to the slide table 1*a*. The bearing 11 has a slit 24 formed therein, and the axial movement of the shaft 10 and the inclination of the guide 21 are fixed by rotating a lever 12 so as to close the slit 24.

A U-shaped member 7 is mounted on the guide 21 so as to be adjustable in position along the guide 21. The U-shaped member 7 includes upper and lower jaws 5 and 6, respectively, and a connecting portion 25 which connects the upper and lower jaws 5 and 6. The lower jaw 6 includes an upwardly extending bill 6*a*. The bill 6*a* has a longitudinal length longer than a distance which is defined between a wheel wall portion 4*a*, where a valve hole is to be punched out of the wheel wall, and a wheel end 4*b* on the side adjacent the wheel wall portion 4*a* in the direction at a right angle with the wheel wall portion 4*a*. More particularly, a threaded shaft 14 is mounted between the guide 21 and the U-shaped member 7. The guide 21 includes a first arm 26 and the U-shaped member 7 includes a second arm 15.

The threaded shaft 14 is rotatably connected to the arm 26 and also threadingly engages the arm 15. Thus, the threaded shaft 14 couples the first and second arms 26 and 15. Rotation of the threaded shaft 14 by a handle 13 fixed to the shaft 14 moves one of the U-shaped member 7 and the guide 21. Therefore, rotation of the threaded shaft 14 adjusts the position of the U-shaped member 7 relative to the guide 21.

A punch mounting block 16 is mounted on the U-shaped member 7 so as to be slidable with respect to the U-shaped member 7 along the connecting portion 25 thereof. A driving cylinder 20 is mounted on the upper jaw 5 so as to drive the punch mounting block 16 along the connecting portion 25 of the shaped member 7. The cylinder portion **20*b* of the driving cylinder 20 is connected to the upper jaw 5 and the rod portion 20*a* of the cylinder 20 is connected to the punch mounting block 16. A punch 17 for punching a valve hole in a wheel wall in cooperation with the bill 6*a* is mounted on the punch mounting block 16. The punch 17 is connected to the lower portion of the punch mounting block 16 by a bolt 27. The punch 17, the bill 6*a* and the cylinder 20** are arranged coaxially with one another.

A stripper 18 is disposed in the vicinity of the punch 17 so as to move relative to the punch 17 and is urged in the direction away from the punch mounting block 16. A spring 19 is disposed between the stripper 18 and the punch mounting block 16 and the stripper 18 is urged by the spring 19.

A table 28 is provided having a horizontally extending upper surface. A wheel 4 into which a valve hole to be punched is slid toward and away from the punching position between the punch 17 and the bill **6*a*. The table 28 is mounted on the front side of the U-shaped member 7. A stopper 29 is provided for stopping a wheel 4 to be punched at the punching position. The stopper 29 is mounted in the vicinity of the U-shaped member 7. Such a stopper 29 is usually disposed in a fixed relationship relative to the table 28. When a size of a wheel 4 is changed, the slide table 1*a* must be adjusted in position so as to correspond to a change in the punching position corresponding to a change in the type of wheel to be punched. However, when the stopper 29 is provided so as to be horizontally adjustable in position, the slide table la is not necessary because the punching position can be adjusted by adjusting the position of the stopper 29**.

Next, operation of the apparatus will be explained.

When the type of wheel to be punched is changed, inclination of the guide 21 together with the U-shaped member 7 including the bill **6*a* and the punch 17 is adjusted by rotating the handle 9 so that the common axis of the punch 17 and the bill 6*a* extends at a right angle with respect to the wheel portion 4*a* where a valve hole is to be punched. Also, the slide table 1*a* or the stopper 29 is adjusted in position horizontally by rotating the handle 2 or adjusting the stopper 29 so that the common axis of the punch 17 and the bill 6*a* passes through the portion 4*a***.

In the punching process, a wheel 4 into which a valve hole is to be punched is slid on the upper surface of the table 28 and is brought to the punching position with the axis thereof maintained vertical. The wheel hits the stopper 29 and stops at the punching position. The positioning of the wheel 4 relative to the punching position can be accomplished very easily due to the simple sliding of the wheel 4 on the table 28.

Thereafter, the cylinder 20 is operated to drive the punch mounting block 16 and the punch 17 toward the wheel 4. When the punch 17 hits the wheel wall portion **4*a*, the punch 17 stops at this position. When the cylinder 20 is successively operated and the rod portion 20*a* of the cylinder 20 continues to protrude further from the cylinder portion 20*b*, the U-shaped member 7, in turn, moves upwardly relative to the punch mounting block 16. Therefore, the bill 6*a* is moved toward the punch 17. Since the bill 6*a* extends upwardly, the lower jaw 6 does not interfere with the wheel wall. When the bill 6*a* reaches at last the wheel portion 4*a* and is further moved upwardly, a valve hole is punched out in the wheel wall portion 4*a* by the punch 17 and the bill 6*a*. The punch 17 and the bill 6*a* hit the wheel portion 4*a*** at a right angle. Accordingly, the punching operation is performed very smoothly.

After punching, the cylinder 20 is operated in a reverse direction. The bill **6*a* is moved in the direction away from the portion 4*a* and, successively, the punch is moved upwardly in the direction away from the portion 4*a*. The stripper 18 helps the punch 17 separate from the wheel 4. The punched wheel is removed away from the punching position and then a successive wheel 4** is brought to the punching position and the above process is repeated.

According to the apparatus of the present invention, since a wheel can be brought to the punching position with its axis maintained in a vertical direction, handling of the wheel is very easy. Therefore, punching efficiency is improved. Further, by hitting the punch 17 and the bill **6*a* at a right angle, punching is done very smoothly and with high accuracy. Furthermore, since the adjustment of hitting at a right angle is performed only by rotation of the screw shaft 10, the adjustment is very easy as well as the adjustment mechanism is very simple. In addition, since the position of the U-shaped member 7 can be adjusted in position relative to the guide 21, adjustment of the vertical position of the punch 17 and the bill 6*a*, which is needed in correspondence with any change in the type of wheel to be punched, can be performed very easily by rotating the threaded shaft 14. The adjustment mechanism is very simple. Also, since the U-shaped member 7 including the bill 6*a*** can move upwardly, the height of the apparatus can be kept low.

Although only one embodiment of the present invention has been described in detail above, it will be appreciated by those skilled in the art that various modifications and alterations can be made to the particular embodiment shown without materially departing from the novel teachings and advantages of the present invention. Accordingly, it is to be understood that all such modifications and alterations are included within the spirit and scope of the present invention as defined by the following claims.

What is claimed is:

1. A valve hole punching apparatus for punching out a valve hole in wheel, the wheel comprising an annular member having radially outwardly projecting end portions and an intermediate portion, the valve hole being punched out in a portion of the intermediate portion inclined with respect to an axis of the wheel, said apparatus comprising: a frame, a guide;

means adjustably mounting said guide on said frame for changing the inclination of said guide relative to said frame;

a longitudinally extending U-shaped member mounted on said guide for movement therewith, said U-shaped member including upper and lower jaws and a connecting portion connecting said upper and lower jaws, said lower jaw including an upwardly extending bill;

means, located between said guide and said U-shaped member, for adjusting the position of said U-shaped member relative to said guide;

a punch mounting block slidably mounted on said connecting portion of said U-shaped member so as to be slidable with respect to said U-shaped member between said upper and lower jaws, said punch mounting block including a first surface portion extending in parallel with said connecting portion of said U-shaped member and second and third surface portions provided at upper and lower ends of said first portion, respectively, extending in a direction substantially at right angles to said connecting portion of said U-shaped member, said punch mounting block being slidably coupled to said connecting portion of said U-shaped member at said first portion;

driving means including a piston attached to a piston rod and a cylinder, for moving said punch mounting block relative to said U-shaped member, said upper jaw being connected to said cylinder of said driving means, said second portion of said punch mounting block being connected to said piston rod; and a punch, mounted on said punch mounting block at said third portion of said punch mounting block, for punching out a valve hole in an inclined portion of an intermediate portion of a wheel in cooperation with said bill, said guide, said U-shaped member and said punch mounting block being operatively coupled whereby prior to operating the apparatus, said guide may be adjusted in inclination so as to extend in a direction perpendicular to a wheel wall portion where a valve hole is to be punched out and an initial position of said punch may be adjusted by said U-shaped member position adjusting means so as to be located a little higher than said wheel wall portion where a valve hole is to be punched out, and in operating the apparatus, first said between said punch mounting block and said U-shaped member up to a position where said punch engages a wheel wall, then said bill may be moved obliquely upward through sliding movement between said punch mounting block and said U-shaped member up to a position where said bill engages said wheel wall portion, and then said punch and said bill may be further moved relative to each other to punch out a valve hole in said wheel wall portion.

2. The apparatus according to claim 1, further comprising a slide table adapted so as to be adjustable in position horizontally and wherein said U-shaped member is mounted on said slide table so that said U-shaped member is adjustable in inclination with respect to said slide table.

3. A valve hole punching apparatus for punching out a valve hole in a wheel, the wheel comprising an annular member having radially outwardly projecting end portions and an intermediate portion, the valve hole being punched out in a portion of the intermediate portion inclined with respect to an axis of the wheel, said apparatus comprising:

a fixed frame;

a slide table so as to be adjustable in position horizontally with respect to said fixed frame;

a guide;

means adjustably mounting said guide on said fixed frame for changing the inclination of said guide relative to said fixed frame;

a longtudinally extending U-shaped member mounted on said guide, for movement therewith, said U-shaped member including upper and lower jaws and a connecting portion connecting said upper and lower jaws, said lower jaw including an upwardly extending bill;

means, located between said guide and said U-shaped member, for adjusting the position of said U-shaped member relative to said guide;

a punch mounting block slidably mounted on said connecting portion of said U-shaped member so as to be slidable with respect to said U-shaped member between said upper and lower jaws, said punch mounting block comprising a member including a first surface portion extending in parallel with said connecting portion of said U-shaped member and second and third surface portions provided at upper and lower ends of said first portion, respectively, extending in a direction substantially at right angles to said connecting portion of said U-shaped member, said punch mounting block being slidably coupled to said connecting portion of said U-shaped member at said first portion;

driving means, including a postion attached to a piston rod and a cylinder for moving said punch mounting block relative to said U-shaped member, said upper jaw being connected to said cylinder of said driving means, said second portion of said punch mounting block being connected to said piston rod; and a punch, mounted on said punch mounting block at said third portion of said punch mounting block, for punching out a valve hole in an inclined portion of an intermediate portion of a wheel in cooperative with said bill, said guide, said U-shaped member and said punch mounting block being operatively coupled whereby prior to operating the apparatus, said guide may be adjusted in inclination so as to extend in a direction perpendicular to a wheel wall portion where a valve hole is to be punched out and an initial position of said punch may be adjusted by said U-shaped member position adjusting means so as o be located a little higher than said wheel wall portion where a valve hole is to be punched out, and in operating the apparatus, first said punch may be moved obliquely downward through sliding movement between said punch mounting block and said U-shaped member up to a position where said punch engages a wheel wall, then said bill may be moved obliquely upward through sliding movement between said punch mounting block and said U-shaped member up to a position where said bill engages said wheel wall portion, and then said punch and said bill may be further moved relative to each other to punch out a valve hole in said wheel wall portion.

4. The apparatus according to claim 3, further comprising screw means mounted between said fixed frame and said slide table, and wherein said screw means is rotatably but axially fixedly supported by said fixed frame and threadingly engages said slide table so that rotation of said screw means moves said slide table horizontally with respect to said fixed frame.

5. The apparatus according to claim 3, further comprising:

support means mounted between said slide table and said guide, said support means pivotally connecting said slide table and said guide;

bearing means pivotally connected to said slide table, said bearing means having threads on the inside surface thereof; and threaded shaft means mounted between said bearing means and said guide, said threaded shaft means threadingly engaging the threads of said bearing means and being pivotally connected to said guide so that rotation of said threaded shaft means axially moves said threaded shaft means and varies an inclination of said guide with respect to said slide table.

6. The apparatus according to claim 3, wherein said U-shaped member position adjusting means includes a first arm connected to said guide, a second arm connected to said U-shaped member, and a threaded shaft means mounted coupled to said first and second arms so that rotation of said thereafter shaft moves one of said guide and said U-shaped member relative to the other.

7. The apparatus according to claim 3, wherein, said punch and said bill are arranged coaxially with each other.

8. The apparatus according to claim 3, wherein said bill has a longitudinal height longer than a distance defined between a wheel portion where a valve hole is to be punched out and an axially end portion of the wheel adjacent to said wheel portion in the direction at a right angle with respect to said wheel portion.

9. The apparatus according to claim 3, further comprising a stripper disposed in the vicinity of said punch and urged in the direction away from said punch mounting block.

10. The apparatus according to claim 9, further comprising spring means disposed between said stripper and said punch mounting block and wherein said stripper is urged by said spring means.

* * * * *